United States Patent [19]

Spangler

[11] 4,064,624

[45] Dec. 27, 1977

[54] SEPARABLE FUNNEL GUIDE AND CRIMPING DIE ASSEMBLY

[75] Inventor: Paul Joseph Spangler, Novelty, Ohio

[73] Assignee: International Telephone and Telegraph Corporation, New York, N.Y.

[21] Appl. No.: 696,638

[22] Filed: June 16, 1976

[51] Int. Cl.[2] ..... H01R 43/04

[52] U.S. Cl. ..... 29/753; 29/748

[58] Field of Search ..... 29/203 D, 203 DT, 203 DS, 29/203 P, 203 S, 628, 630 R, 630 A, 747, 748, 753, 761

[56] References Cited

U.S. PATENT DOCUMENTS

| | | | |
|---|---|---|---|
| 2,545,756 | 3/1951 | Andren | 29/203 DT |
| 3,264,860 | 8/1966 | Herb | 29/203 DS |
| 3,553,814 | 1/1971 | Rider | 29/203 DS |
| 3,693,230 | 9/1972 | Morgan | 29/203 D |
| 3,710,483 | 1/1973 | Morgan et al. | 29/203 DT |
| 3,858,292 | 1/1975 | Gudmestad | 29/203 DT |

*Primary Examiner*—Victor A. DiPalma

*Attorney, Agent, or Firm*—James B. Raden; William J. Michals

[57] ABSTRACT

An automatic terminal applicator in which stripped wire ends are automatically guided and inserted into the insulation and wire barrel portions of terminals attached to a moving belt is disclosed. The belt is indexed through the crimping station between the upper and lower insulation and wire crimping dies of the press. A split funnel guide includes a spring-loaded portion and a complementary stationary portion respectively fastened with the upper and lower crimping dies. When the dies are closed, an aperture is formed at the apex of the funnel immediately adjacent the insulation portion of the leading terminal and whose cross-sectional area is no greater than the corresponding area of the insulation portion of the terminal. The wire is positioned transversely of the terminal and coaxial therewith. Thereafter, the wire is inserted into the funnel and guided thereby into the barrel of the terminal. Upon completion of the crimping operation, the dies, and therefore the split funnel, are separated thereby permitting the completed lead to be indexed or ejected away from the crimping station.

9 Claims, 3 Drawing Figures

SEPARABLE FUNNEL GUIDE AND CRIMPING DIE ASSEMBLY

BACKGROUND OF THE INVENTION

This invention relates to automatic terminal applicators and, more particularly, to such applicators wherein funnel entry terminals on a continuous belt are crimped onto the stripped ends of insulated wires and wherein the wire is automatically inserted into the ferrule and conductor barrels of the terminal.

Automatic terminal applicators or lead making machines are known and have been used in the art. Such machines are exemplified in U.S. Pat. No. 3,019,679. However, these machines are sophisticated and complex and, accordingly, require initial production set-up and continual maintenance by a skilled operator in order to continuously produce satisfactorily completed leads. This problem is particularly acute in the case of closed barrel terminals wherein the wire end must be precisely inserted into the insulation and conductor barrels of the terminal. That is, to produce an acceptable or satisfactory lead, the wire must not only be inserted only a given predetermined distance into the terminals but that all of the strands of the wire must be positioned within the conductor or wire barrel of the terminal prior to crimping. This problem is attributable to the unreliable manner in which these prior art automatic machines align the wire leads for insertion into the terminal. That is, a positive guide means has not been provided and the task of precisely inserting the leads has often been left to chance. Accordingly, it has been found that to assure a reliable yield of completed leads, a "100%" inspection is generally required. Obviously, this defeats the ultimate function of a fully automatic terminal applicator machine.

In semi-automatic or strictly manual lead making operations wherein an operator inserts each individual wire between the dies of a crimping press, various wire guide means have been proposed and utilized to assist the operator in this function. Such wire guide means are exemplified in U.S. Pat. No. 3,693,230, which is assigned to the same assignee as the present invention. Heretofore, it has been believed that insertion of a wire into a terminal ferrule for crimping cannot readily be effected by automatic machine methods. While the provision of an operator does also provide a means for assuring reliability by virtue of the opportunity for simultaneous inspection, this has an obvious disadvantage in terms of production speed and therefore manufacturing cost particularly when compared to the ultimate design capabilities of a fully automatic machine.

These and other disadvantages are overcome by the present invention wherein an automatic terminal applicator machine which is particularly suitable for use with closed barrel terminals is provided. it has been found that the terminal applicator in accordance with the present invention, owing to its relative simplicity and positive acting wire guide means, reliably produces leads at an automatic production rate without the attendant disadvantages of having to provide a skilled operator to continuously maintain the machine in its intended operating mode.

SUMMARY OF THE INVENTION

Briefly, an automatic terminal applicator machine wherein terminals on a continuous belt are crimped onto the stripped ends of insulated wires which are inserted into the barrels of the terminals is provided. A pair of cooperable dies which are movable relatively towards and away from each other are provided to crimp a terminal located therebetween onto the stripped end of the wire. Belt feeding means are provided adjacent one side of the dies and is effective to index the belt along a path extending past the dies on the one side thereby to locate the leading terminal on the belt between the dies. Means cooperating with the feeding means are provided for positioning a wire transversely of the belt and substantially coaxial with the located terminal. Means are provided for inserting the wire into the terminal and means for guiding the wire into the terminal are provided. The guiding means comprise a separable wire guide having first and second complementary sections respectively fastened to the crimping dies at the other side thereof. The wire guides are therefore translatable with the dies and a funnel is formed when the dies are closed. The funnel terminates in an aperture at the apex thereof which is immediately adjacent the terminal and whose cross-sectional area is no greater than the cross-sectional area of the adjacent barrel of the terminal. Finally, means are provided for ejecting the wire in the feeding direction of the belt after the dies have crimped the terminal on the wire and the funnel guide sections have separated.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
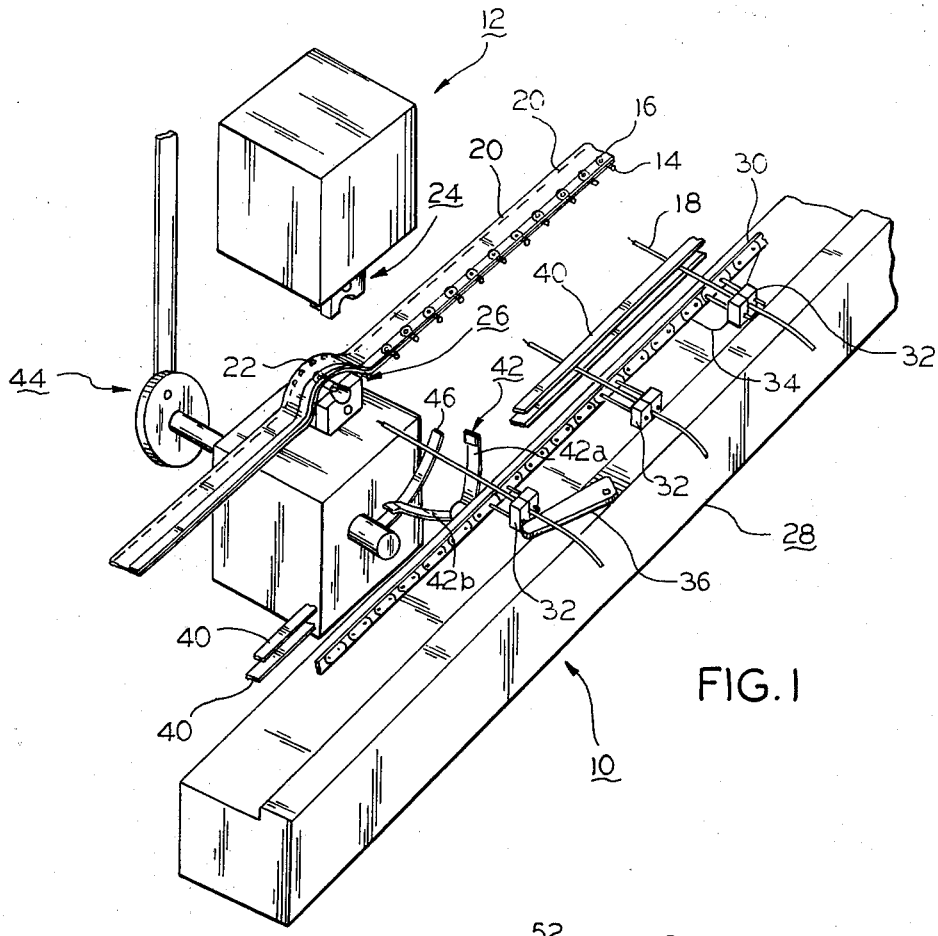
FIG. 1 is a perspective view of an automatic terminal applicator including wire guide means in accordance with the present invention.

Referring now to FIG. 1, there is shown generally at 10 an automatic terminal applicator machine comprising a crimping press 12 which is used to crimp terminals 14 of belt 6 onto the ends of wires 18. Belt 16 includes perforations 20 which engage the teeth of a sprocket wheel 22 which is driven by an indexing means (not shown) which presents or locates the leading terminal between funnel guide and crimping die assembly members 24 and 26 of crimping press 12. Wires 18 are positioned transversely of belt 16 and coaxial with each leading terminal by means of a conveyor 28. Conveyer 28 is the delivery end of an automatic wire measuring, cutting and conveying system of the type manufactured by the Artos Engineering Company, such as their model CS6-CTU.

Wires 18 are conveyed and delivered to the crimping station by means of a continuous chain 30 which carries releasable wire clamps 32 which are initially cammed outwardly by means of a suitable cam surface 34. At the crimping station, each successive wire clamp 32 is inserted inwardly toward the crimping station by means of a flipper 36 which is synchronized with each operating cycle of crimping press 12 by means of a central control unit (not shown). The wires 18 are guided into an approximate coaxial relationship with each leading terminal by means of horizontal guide bars 40 which are suitably mounted to the frame of the terminal applicator 10 and by means of a wire guide mechanism 42 having arms 42*a* and 42*b* which are positioned vertically to capture each successive wire 18 therebetween.

Each successive wire 18 is inserted into the closed barrel of the respective leading terminal 14 and is guided therein by guide means carried by assembly members 24 and 26 as explained more fully hereinafter. Once wire 18 is inserted into the barrel of the leading terminal, crimping press 12 is cycled so as to close the crimping dies of assemblies 24 and 26 thereby crimping the leading terminal onto the positioned wire 18. Thereafter, assembly members 24 and 26 separate at which time a suitable linkage 44, which is mechanically coupled to the press ram (not shown), rotates to cause a flipper member 46 to eject the completed lead from the crimping station while breaking the crimped terminal 14 from the continuous belt 16. The overall operation of terminal applicator 10 and, more particularly, the novel ejection and completed terminal breaking apparatus is fully described in my copending application Ser. No. 685,794, filed May 12, 1976, now U.S. Pat. No. 4,043,032, to which reference may be had for a more complete description.

Figure 2:
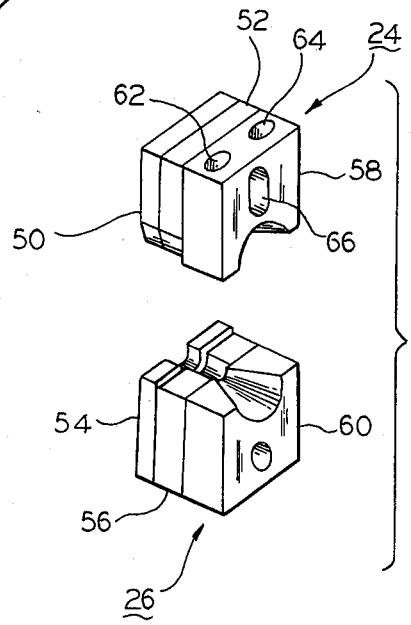
FIG. 2 is a partial perspective view of the preferred funnel guide and crimping die assembly for use with the automatic terminal applicator depicted in FIG. 1; and, FIG. 3 is a cross-sectional side view of the funnel guide and crimping die assembly in accordance with the present invention.

Referring now to FIG. 2, there is shown a partial perspective view of funnel guide and crimping die assembly members 24 and 26 which illustrates somewhat more clearly the separable wire guide means which are fastened thereto and translated thereby. The upper die structure includes an electrical or wire crimping die 50 and an insulation crimping die 52 which respectively cooperate with lower or anvil dies 54 and 56 of assembly member 26. Assembly members 24 and 26 are further provided with cooperating complementary funnel guide members 58 and 60. In the closed position, funnal guide members 58 and 60 form a closed funnel which tapers inwardly toward the insulation and wire crimping dies. That is, in the closed position, funnel guide members 56 and 58 form a funnel which is continuously closed in its radial direction and which forms an aperture at the apex thereof whose cross-sectional area is no greater than the cross-sectional area of the immediately adjacent ferrule or barrel of terminal 14. Further, the outlet aperture thereby provided is located immediately adjacent the terminal located between the crimping dies.

Funnel guide member 58 is preferably provided with bores 62 and 64, and an elongated mounting slot 66. Bores 62 and 64 receive compression springs which cooperate with an associated die holder and slott 66 to provide a pre-advance of funnel guide members 58 and 60 as described more fully hereinafter.

Figure 3:
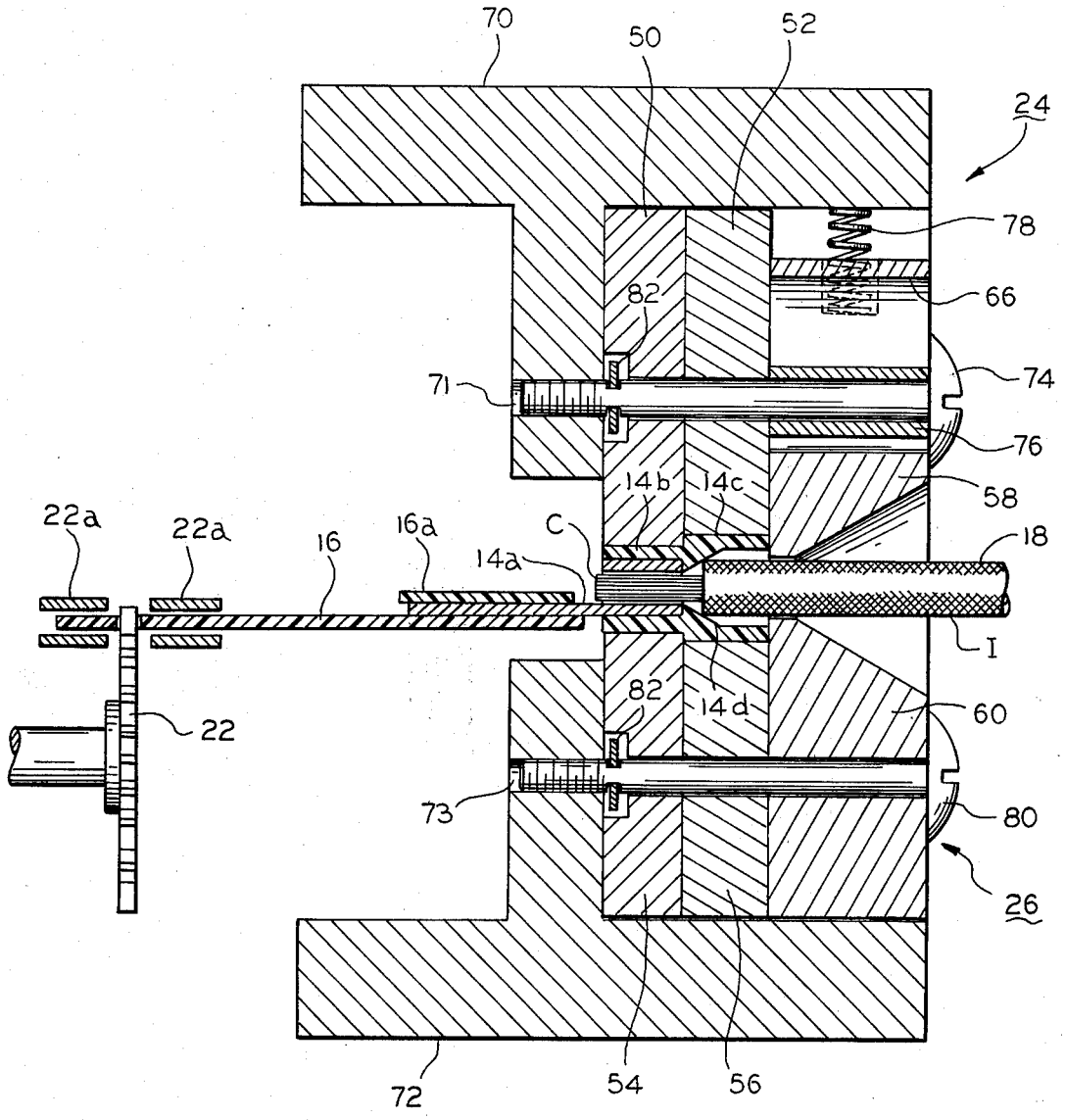

Referring now to FIG. 3, there is shown a cross-sectional side view of the separable funnel guide and crimping die assembly which is particularly suitable for use with an automatic terminal applicator in accordance with the principles of the present invention. Belt 16 is indexed by means of sprocket wheel 22 and guided thereon by means of belt guides 22*a*. The terminal tongue 14*a* of terminal 14 is removably fastened to belt 16 by means of a strip 16*a* which generally comprises a Mylar strip which is tack welded to belt 16. Terminal 14 includes an electrical or conductor barrel 14*b* and an insulated funnel ferrule 14*c* which is provided with an integral funnel 14*d* to facilitate insertion of conductor portion C of wire 18 into the closed conductor barrel 14*b*.

The separable funnel guide and crimping die assembly of FIG. 3 comprises an upper die holder 70 which is movable relative to a stationary or lower die holder 72. Funnel guide member 58, insulation crimping die 52 and conductor crimping die 50 are suitably fastened to die holder 70 as by means of a bolt 74 which threadedly engages upper die holder 70 as at 71. A spacer bushing 76 surrounds the shaft of bolt 74 and functions to rigidly fasten crimping dies 50 and 52 against the depending portion of upper die holder 70 while permitting funnel member 58 to move a given vertical distance as determined by the length of elongated slot 66. Funnel guide member 58 is preferably biased downwardly such as by means of a spring 78 disposed between the bottom surface of bore 64 and upper die holder 70. A second spring (not shown in FIG. 3) is similarly disposed in bore 62. This then permits funnel guide members 58 and 60 to engage one another in their complementary relationship prior to the crimping of terminal 14. That is, funnel guide member 58 and 60 engage to form a closed funnel prior to engagement of crimping dies 50 and 52 with terminal 14. Thus, a fully closed funnel is provided to accomodate the insertion step of the wire while avoiding any premature crimping of the terminal — which could otherwise disadvantageously reduce the cross section of the conductor and insulation barrels of the terminal.

Similarly, funnel guide member 60, insulation crimping die 56 and wire crimping die 54 are rigidly fastened to lower die holder 72 by means of a bolt 80 which threadedly engages lower die holder 72 as at 73. Assembly members 24 and 26 each include a lock ring member 82 which function to maintain the assembled relationships of the various elements when they are removed from their respective die holders. This has the advantage that an accidental transposition of the insulation and crimping dies, or other dies, is avoided.

It will now be appreciated that the separable funnel guide and crimping die assembly as depicted in FIG. 3 facilitates a positive and therefore reliable insertion of stripped wire ends into the barrel portions of the leading terminal. That is, a fixed and completely closed funnel is provided prior to the crimping operation, the outlet of which is immediately adjacent to the terminal, to ensure that the conductor portion C of each wire is completely and precisely inserted into the wire crimping barrel of the terminals. Further, after the crimping operation, the funnel guide, in accordance with the present invention, separates to allow the completed lead to be ejected from the automatic terminal applicator without interference thereby.

What has been taught, then, is a fully automatic terminal applicator wherein a separable funnel guide and crimping die assembly is provided and which facilitates, notably, reliable completed lead production and at rates concomitant with the capabilities of fully automatic machines.

The form of the invention illustrated and described herein is the preferred embodiment of these teachings, in the form currently preferred for manufacture. It is shown as an illustration of the inventive concept, however, rather than by way of limitation, and it is pointed out that various modifications and alterations may be indulged in within the scope of the appended claims.

What is claimed is:

1. An automatic terminal applicator machine wherein terminals on a continuous belt and extending laterally thereof are crimped onto the stripped ends of insulated wires which are inserted into the insulation and wire barrels of the terminals, said applicator comprising:

a pair of cooperable dies, said dies being movable relatively towards and away from each other to crimp a terminal located therebetween onto the stripped end of an insulated wire and each die including insulation and wire crimping portions;

belt feeding means adjacent one side of said dies, said feeding means being effective to index said belt along a path extending past said dies on said one side thereby to locate the leading terminal on said belt between said dies;

means cooperating with said feeding means for positioning a wire transversely of said belt and substantially coaxial with said leading terminal;

means for inserting said wire into said leading terminal;

means for guiding said wire into said terminal comprising a separable wire guide having first and second complementary sections respectively fastened to said crimping dies at the other side thereof and translatable therewith, wherein a funnel is formed when said dies are closed, said funnel being closed in its radial direction and having an aperture at the apex thereof which is immediately adjacent and abutting against said leading terminal and whose cross-sectional area is no greater than the cross-sectional area of the adjacent insulation barrel of said terminal; and, means for ejecting said wire in the feeding direction of said belt after said dies have crimped said leading terminal on said wire and said funnel guide sections have moved away from each other.

2. A separable funnel guide and crimping die assembly for use with an automatic terminal applicator wherein funnel entry terminals on a continuous belt are crimped onto the stripped end of an insulated wire and wherein the wire is automatically inserted into the ferrule and conductor barrel of the terminal, said assembly comprising, in combination:

a stationary die holder and a movable die holder;

said stationary die holder having a stationary conductor crimping die, a stationary insulation die and a first funnel guide segment mounted thereon wherein said insulation die is intermediate said stationary insulation die and said funnel guide segment;

said movable die holder having a movable conductor die and a movable insulation die mounted thereon and respectively cooperating with said stationary conductor and insulation dies, said movable holder further including a second funnel guide segment complementary to said first segment wherein said segments form a substantially closed funnel tapering towards said insulation dies when said segments are moved into engagement; and, said funnel terminating in an aperture at the apex thereof abutting against said ferrule and wherein the cross-sectional area of said aperture is greater than the area of the opening of the conductor barrel of said terminal but no greater than the opening of said ferrule.

3. A method for automatically crimping terminal devices onto wire, said terminal devices being secured to a belt in side-by-side relationship with their axes extending laterally of the belt, said method comprising the steps of:

moving a pair of cooperating crimping dies relatively towards and away from each other to crimp a terminal device located therebetween onto one end of a wire;

guiding said belt along a path extending past said dies and on one side thereof;

indexing said belt toward said dies and between successive crimping operations thereby to locate the next leading terminal on said belt between said dies;

positioning a wire transversely of said belt and substantially coaxial with said leading terminal;

closing a split funnel guide to form a closed funnel guide between said wire and said leading terminal having its smaller opening immediately adjacent and abutting against said leading terminal;

inserting said wire through said funnel and into said leading terminal;

closing said dies to crimp said leading terminal;

separating said split funnel guide while said dies are moving away from each other; and, ejecting the crimped terminal and attached wire from between said dies.

4. The method according to claim 3, wherein the step of crimping said leading terminal includes the step of crimping a funnel ferrule about an insulation portion of said wire.

5. The method according to claim 3, wherein the step of closing said split funnel includes the step of yieldably urging the split sections of said funnel guide toward each other.

6. The apparatus according to claim 1, wherein said means for guiding said wire includes means for closing said first and second sections prior to the insertion of sad wire into said leading terminal.

7. The apparatus according to claim 1, wherein said first section is yieldably urged toward said second section.

8. The apparatus according to claim 1, wherein each of said cooperable dies includes an insulation crimping die and a wire barrel crimping die.

9. The apparatus according to claim 9 wherein said barrels of said terminals are generally cylindrical closed barrels.

* * * * *